US005959593A

United States Patent [19]

Hoshi

[11] Patent Number: 5,959,593

[45] Date of Patent: Sep. 28, 1999

[54] DEVICE FOR TELESCOPING A POWER ANTENNA

[75] Inventor: Hareo Hoshi, Warabi, Japan

[73] Assignee: Nippon Antenna Company Limited, Tokyo, Japan

[21] Appl. No.: 08/875,764

[22] PCT Filed: Feb. 6, 1996

[86] PCT No.: PCT/JP96/00234

§ 371 Date: Aug. 1, 1997

§ 102(e) Date: Aug. 1, 1997

[87] PCT Pub. No.: WO96/24961

PCT Pub. Date: Aug. 15, 1996

[30] Foreign Application Priority Data

Feb. 6, 1995 [JP] Japan ..... 7-039386
Aug. 4, 1995 [JP] Japan ..... 7-218311

[51] Int. Cl.[6] ..... H01Q 1/10

[52] U.S. Cl. ..... 343/903; 343/877; 343/711; 343/713; 343/715

[58] Field of Search ..... 343/877, 903, 343/711, 713, 715

[56] References Cited

U.S. PATENT DOCUMENTS 4,875,053 10/1989 Harada ..... 343/903
5,019,834 5/1991 Suga ..... 343/877
5,235,344 8/1993 Shinkawa ..... 343/903

FOREIGN PATENT DOCUMENTS 58-72760 4/1983 Japan .
1-279602 11/1989 Japan .
5-206712 8/1993 Japan .
6-52204 7/1994 Japan ..... 1/10

*Primary Examiner*—Don Wong
*Assistant Examiner*—James Clinger
*Attorney, Agent, or Firm*—Frishauf, Holtz, Goodman, Langer & Chick, P.C.

[57] ABSTRACT

A power antenna for automatically stopping an electric motor when a telescoping trouble occurs with the antenna to thereby cause a load of more than a predetermined magnitude to be applied to the electric motor and preventing the electric motor from being burned out and a telescoping operating mechanism from getting damaged, whereby the occurrence of an erroneous operation of the antenna such as repeated contracting and expanding operations thereof can be controlled. A worm wheel (2) inside an antenna mechanism is pivotally supported in such a manner as to slide in an axial direction and an engagement groove (21) is formed in an annular fashion, and an operating portion (32) of a movable body (17) of a limit switch (30) provided in a driving circuit for the motor is brought into engagement with the engagement groove (21) of the worm wheel. A columnar engagement body (34) adapted to be activated by an elastic member (7) is brought into engagement in a square groove type engagement recessed portion (33) of the movable body (17) within a height range which is not more than a radius of the columnar engagement body, and a cam portion (35) of a joint portion is disposed on the side of the square groove type engagement recessed portion of the movable body for keeping the engagement body (34) unlocked from the engagement recessed portion (33) when an abnormal operating force is generated relative to the antenna elements.

13 Claims, 9 Drawing Sheets

Fig. 9(A)
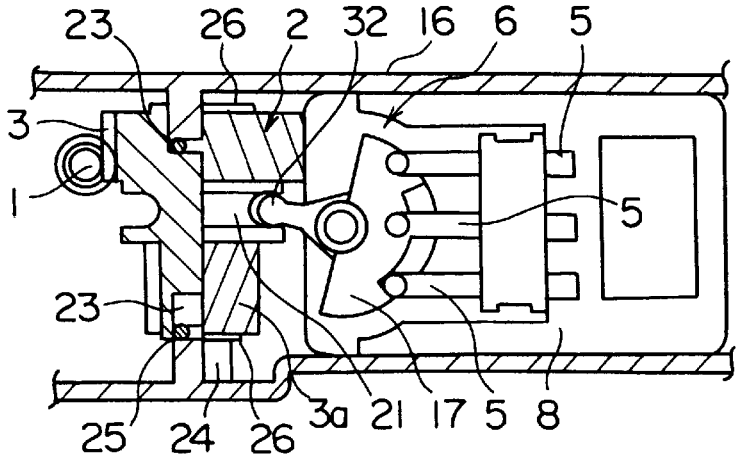
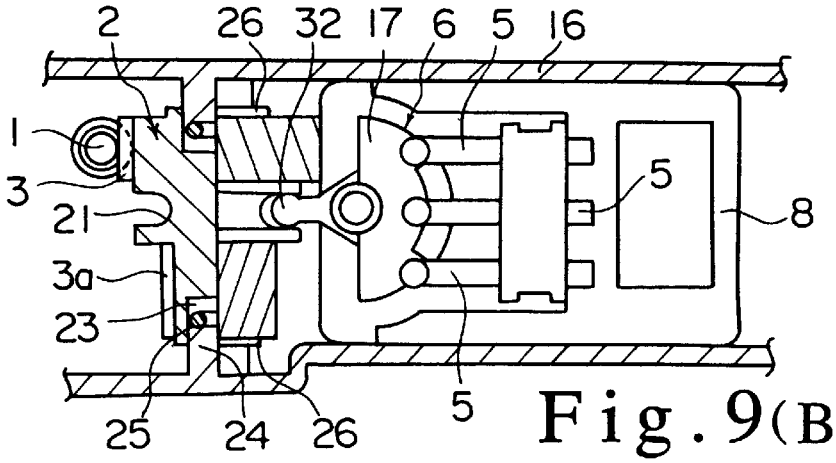
Fig. 9(B)
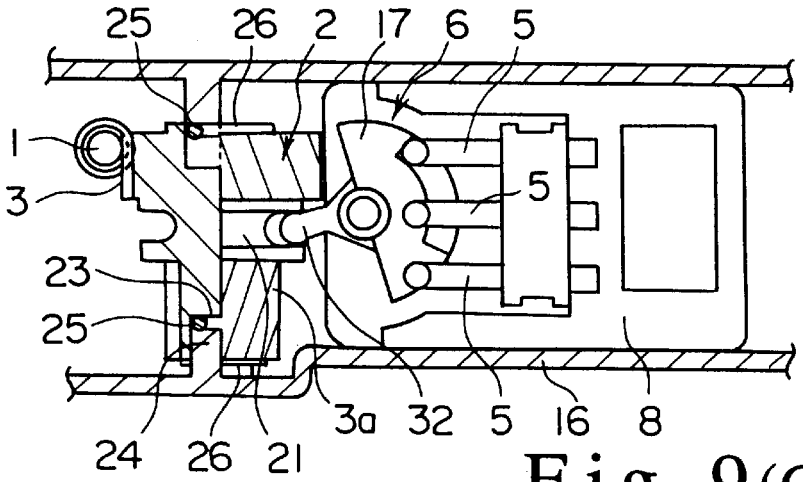
Fig. 9(C)

DEVICE FOR TELESCOPING A POWER ANTENNA

TECHNICAL FIELD

This invention relates to a device for telescoping a power antenna. More particularly, in an electric power antenna mechanism for automatically extending and contracting an antenna by an ON/OFF operation of a radio receiver installed to a car, this invention relates to a device for telescoping a power antenna having a relatively simple construction and yet exhibiting a reliable operation which automatically stops a driving motor when a load exceeding a predetermined level is applied to an antenna driving motor due to a telescoping problem encountered when the antenna is automatically extended or contracted fully, or during its operation. This prevents burn-out of the motor and damage to a telescoping mechanism and can reliably prevent the occurrence of an erroneous operation such as repetition of an UP/DOWN operation.

BACKGROUND ART

Various proposals have been made in the past to telescopically and automatically operate a car antenna by an operation inside a car. The present applicant has made some proposals in JP,A 279602/1989 (Patent Laid-Open No. 279602 laid open in Japan in 1989), JP,A 206712/1993 and JP,U 52204/1994 (Utility Model Laid Open No. 52204 laid open in Japan in 1994). The inventor of the present invention has made various studies on the production methods of these products and their utilization. In other words, when the automatic telescoping operation of the antenna is carried out in these prior art proposals, a moving operation rotary body, such as a drum or a gear for actuating a wire or a rope for telescoping the antenna element by a worm driven by a motor through a worm wheel, is rotated, thereby telescoping the antenna element. In this instance, the worm wheel is slidably disposed on a support shaft for the worm wheel so that the worm wheel has the function of a limit switch for turning ON and OFF the supply of power to the motor.

According to JP,A 279602/1989, the worm wheel driven by the motor is formed into an intermediate gear portion having integrally formed therewith a small diameter gear portion meshing with a rotary body gear portion. This intermediate gear portion is movably set to a support shaft with a gear support frame having a switch operation portion. A limit switch using a reversing spring is set in each power supply circuit for applying a forward rotation or reverse rotation to the motor, and a flexible arm member is disposed on this limit switch and is operated by the switch operation portion of the gear support frame.

JP,A 206712/1993 describes the following construction. A rotary body for telescoping an antenna element and a worm are rotated through a worm wheel engaging with the worm. An intermediate gear member having integrally formed therewith a small diameter gear meshing the worm wheel with the rotary body is provided, the intermediate gear member being movably fitted to a gear member support frame having an operation portion for a switch disposed in a motor driving circuit. A flexible member for locking is fitted to the gear portion support frame, and an engagement/disengagement mechanism for restricting a torque of movement of the gear portion support frame is disposed between the gear portion support frame and the flexible member for locking. A spherical member and a round fitting hole to which the spherical member is fitted are provided as the engagement/disengagement mechanism.

Further, JP,U 52204/1994 describes the following construction. A fixed contact, a movable contact mating with the fixed contact and a fitting recessed portion for engaging and disengaging a push member are disposed on a movable contact plate as a seesaw type operation member which is pivotally supported at its intermediate portion. A gear holding frame is slidably disposed on a shaft member disposed with a gear on a fixed member. The push member is disposed in a recessed portion formed in the gear holding frame through a spring, and when the gear holding frame slides along the shaft member, the push member is fitted into, and is released from, the fitting recessed portion and turns ON and OFF the movable contact plate with respect to a switch fixed contact.

In the construction of JP,A 279602/1989 described above, a reversing force of the antenna rod operating force is stored in the flexible arm member. Therefore, the antenna can be easily returned to the ON state when the operation is made in the reverse direction, and the antenna operation can be so carried out as to correspond to the ON/OFF operation of the radio receiver. However, this reversing force is so great that the motor is mechanically reversely rotated in some cases, for example. For this reason, there occurs the case where the limit switch is again turned ON and repeats the ON-OFF operation. In other words, the motor output is consumed for the extension or contraction of the antenna during the antenna operation, but under the state where the rotary body stops at the extension/contraction limit or due to an abnormal trouble during the extension operation at an intermediate stage, the propulsion force of the intermediate gear portion increases due to the duration of the rotation of the worm, and the switch operation portion operates the flexible arm member to actuate the reversing movable contact plate of the limit switch, so that the contact is opened and the rotation of the motor is stopped. When the motor stops rotating, the reversing force of the flexible arm member and the resilient reaction of the operation wire generates the reversing operation, and the limit switch again turns ON the circuit by this reversing operation force. Thereafter, the operations in both forward and reverse directions are repeated a great number of times, and the ON-OFF operation described above is repeated. The reversing spring prevents this problem, but there remains the possibility of the repetition of the ON-OFF operation. In this construction, the limit switch becomes complicated in structure and expensive.

JP, A 206712/1993 is directed to solving the problems described above. The first embodiment of this reference uses a reversing auxiliary flexible member corresponding to the flexible arm member of JP,A 279602/1989 as means for obtaining an auxiliary force for returning to the neutral position of the switch, and requires a large number of members besides the slide switch. Therefore, the construction is complicated, there are various conditions for limiting the interaction of these members, and assembly work becomes more difficult. The second embodiment of this reference constitutes the limit switch by a rotary body, and separates the operating force for shifting the rotary body to the OFF state from the operating force for returning to the ON state from this OFF state. A large operating force is necessary for shifting the rotary body to the OFF state as described above, and can be allowed to correspond to the operating force required for the operation of the antenna rod. However, there is no reversing operating force for returning as described above, and the returning operation cannot be attained unless an operating force overcoming the frictional resistance between the members is given.

Namely, when the operating force reaches a set operating force, the UP limit switch is turned OFF and the motor stops rotating, the motor causes mechanical reversing rotation due to the reaction force at that instant, and even when the rod operating force decreases and reaches zero, the UP limit switch cannot be again turned ON. Therefore, there is no possibility of the repetition of the ON-OFF operation, but when the DOWN operation is effected next from this state, there is a reaction force against this operation. If this reaction force is greater than the contact resistance between the members, the antenna element can return and the antenna operation can be carried out in such a manner as to correspond to ON-OFF of the radio receiver. A cam shaped portions having a predetermined cam shape are disposed on both sides of the engagement recessed portion of the rotary body so as to cope with the contact resistance, and these cam shaped portions impart the self-returning force when the reaction force described above is smaller than the contact resistance between the members. However, since this structure is complicated, troubles such as fall-down, unstable rotation, etc., are likely to occur depending on the gap or on the degree of the resistance.

To eliminate the problems described above, it is necessary to apply a grease to the contact surface between the substrate and the rotary body, between the worm wheel support shaft and worm wheel axis and between the worm wheel support shaft and the gear portion support frame, or to restrict the fastening torque of the screw for fitting the rotary body. Further, a rolling body is allowed to disengage at a predetermined operating force and to rotate, and the worm and the support instantaneously move with this disengagement, and their impact sound with the main body case, etc., occurs. Even if a portion such as a rotation stopper is disposed so as to avoid this problem, a similar impact sound occurs at this rotation stopper portion, and such an impact exerts influences on the switch operation and is not desirable. Because a frame body (accommodation hole) for holding the flexible member and the engagement protuberance portion is disposed on the inner wall of the case body, the operation balance of the engagement protuberance with the direct rotary body is lost if any external force acts on the case body or any deformation occurs on the wall surface itself, so that a stable and smooth switching operation mechanism cannot be attained. Incidentally, the rolling body or the engagement protuberance for constituting the engagement/disengagement mechanism in this prior art have a spherical shape, and the engagement portion of the switch rotary body forms a round recessed portion. However, the switching operation between these bodies delicately changes if the lubricating oil and dust adhere to the round recessed portion and to the joint surface of the engagement protuberance, and it has been confirmed that the stable operation cannot always be insured.

In JP,U 52204/1994, further, an operation circuit is formed as a switch whose intermediate state shown in the drawing is just a momentary passing point in any condition and which can be stably held in either side condition. Therefore, when the motor is stopped at the full extension or contraction of the antenna rod or at the overload, the next operation that can be made simultaneously becomes the one that is reverse to the previous operation, and the repetition of ON-OFF does not occur. However, this reference involves the problem that if a radio program is received during the operation of the antenna rod, the antenna does not correspond to the ON-OFF operation of the radio receiver.

SUMMARY OF THE INVENTION

According to the present invention, a device for telescoping a telescopic power antenna, comprises a moving operation rotary body arranged to move a wire or a rope for telescopically operating a telescopic antenna element; a worm wheel driven by a motor and coupled to the rotary body for causing rotation of the rotary body; and an overload prevention limit switch coupled in a power supply circuit for the motor. The worm wheel is slideably mounted so as to be slideable in an axial direction thereof, and has an engagement groove formed thereon. The limit switch comprises a movable body with an operation portion thereon, the operation portion being coupled in a driving circuit for the motor and being engaged with said engagement groove of the worm wheel. The movable body has a square groove engagement recessed portion formed therein. A columnar engagement body is provided and is resiliently urged by a flexible member into engagement with the square groove engagement recessed portion within a range of a height not greater than the radius of the columnar engagement body. Cam portions are disposed on sides of the square groove engagement recessed portion of said movable body such that the columnar engagement body is kept unlocked from the square groove engagement recessed portion by an operating force of the motor for driving and rotating a worm and the worm wheel under a condition of an occurrence of an abnormal load relative to the antenna element. The rotary body can then take the form of a drum or a gear.

BRIEF DESCRIPTION OF DRAWINGS

FIGS. 9(A)–9(C) are views showing in magnification the operation state of an portion in FIGS. 5(*a*)–5(*c*);

BEST MODE FOR CARRYING OUT THE INVENTION

The present invention will be explained in further detail with reference to the accompanying drawings.

Figure 1:
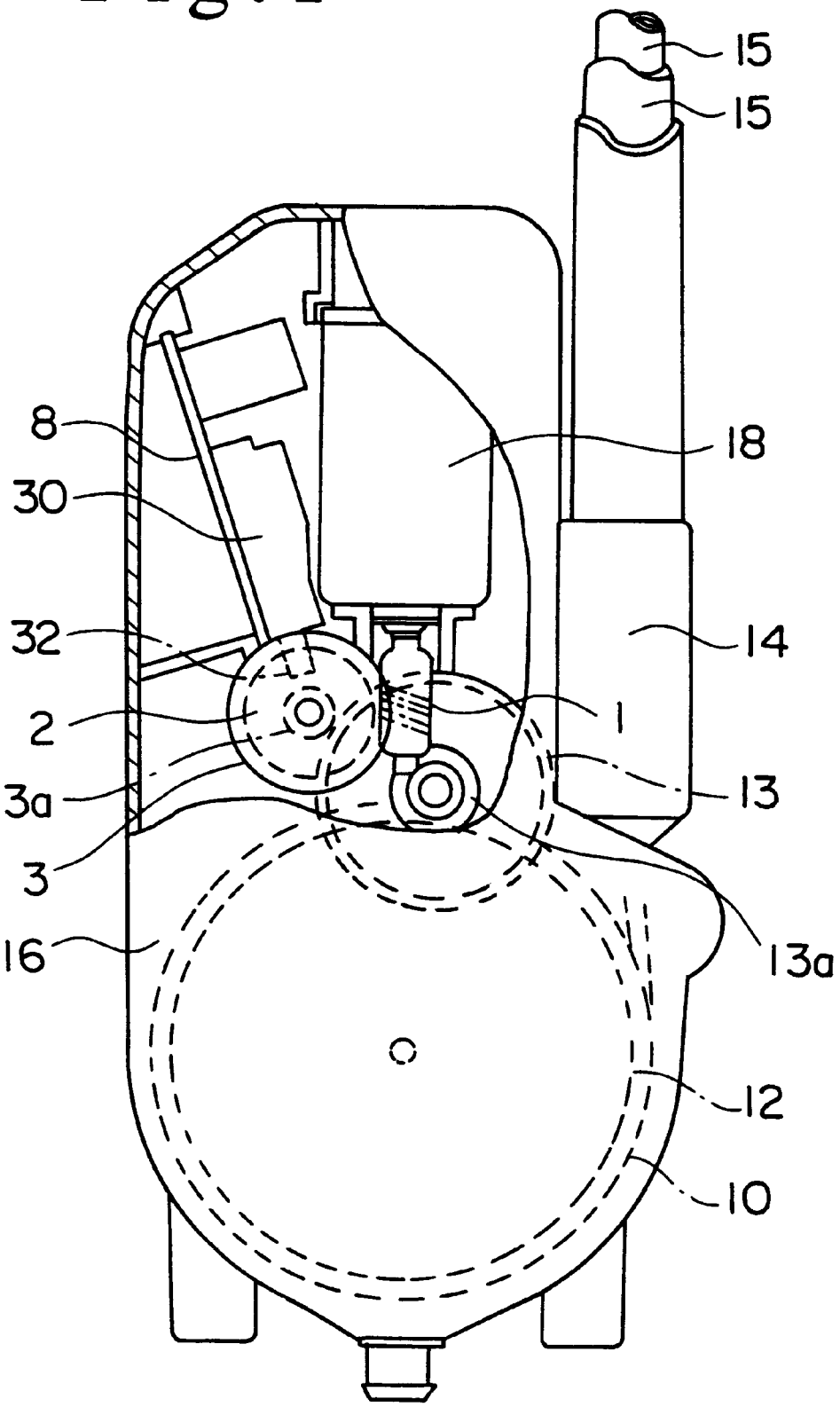
FIG. 1 is a view showing the overall structual relationship of a device for telescoping a power telescopic antenna apparatus according to the present invention.

The overall structural relationship of a device for telescopic operation of a power antenna is shown in FIG. 1. A moving operation rotary body 12 for the telescopic operation of antenna element 15, such as drums or gears meshes with small gear portion 13*a* of an interlocking gear 13 at a lower part of a case member 16. This gear 13 is meshed with a small diameter gear 3*a* of a worm wheel 2, and a large diameter gear 3 of the worm wheel 2 meshes with a worm 1 provided to a rotary shaft of a motor 18. The moving operation rotary body 12 is driven by the motor 18.

An antenna base cylinder 14 is fitted to one of the sides of the case member 16, and antenna elements 15 are accommodated in the antenna base cylinder 14 in multiple stages. A wire or a rope wound on the moving operation rotary body 12 is guided and interconnected to the antenna element 15 of the uppermost stage. In other words, the elements 15 are telescopically operated by the rotation of the moving operation rotary body 12 in the forward or reverse direction as is well known in the art. In the present invention, however, a limit switch 30 on a wiring substrate 8 disposed inside the case member 16 is so disposed as to face the worm wheel 2 in the construction described above.

Figure 2:
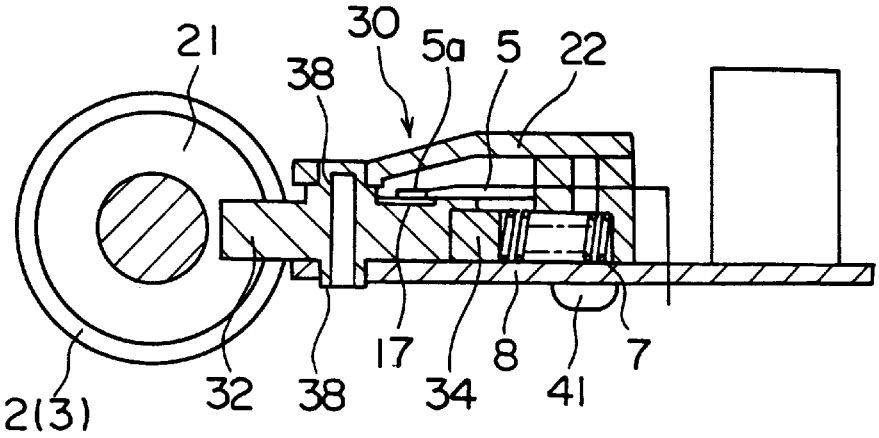
FIG. 2 is a view showing the connection relationship of a switch operating portion and a limit switch with respect to a worm wheel.
Figure 3:
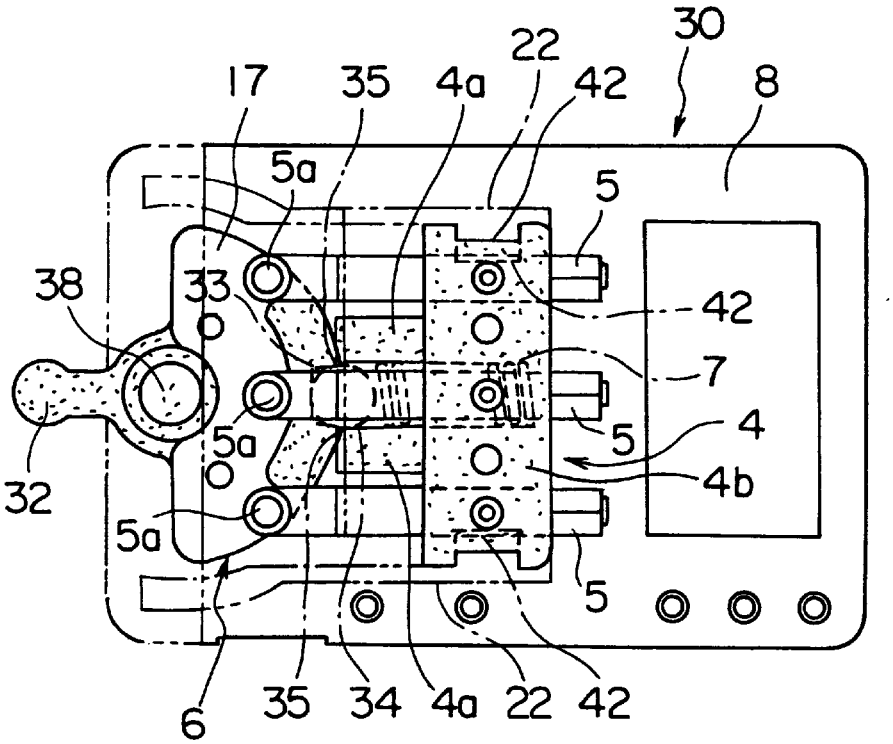
FIG. 3 is a view showing a limit switch and its operating portion.

The fitting relationship between the worm wheel 2 and a limit switch 30 and the detail of their constructions are shown in FIGS. 2 and 3. Three fixed contract plates 5 are integrally formed with a fitting seat 4*b* on a base body 4 fixed by screws to the wiring substrate 8. The proximal end of each fixed contact plate 5 is inserted through the wiring substrate 8 and connected to a circuit of the wiring substrate, while a contact portion 5*a* as the distal end thereof faces a semi-circular movable body 6.

In the movable body 6 shown in FIG. 3, an insulating portion is exposed at an intermediate part of the peripheral portion of its upper surface having a semi-circular shape, but a movable contact 17 made of an electrically conductive material is fitted to the other upper surface of the semicircular portion. A rotary shaft 38 having the axis of rotation thereof at the center of this semi-circle protrudes from both surfaces of the movable body 6, and an operating portion 32 is formed in such a manner as to protrude on the other side from the shaft portion 38. The rotary shaft 38 is pivotally supported by the wiring substrate 8 and the cover body 22 as shown in FIG. 2. Side wall portions 22*a* are suspended from both sides of the cover body 22 as separately shown in FIG. 11, and protuberances 43 formed on the side wall portions 22*a* are anchored to engagement recess portions 42 disposed at both end portions of the fitting seat 4*b* of the base body 4 as indicated by dash lines in FIG. 3.

Extension portions 4*a* and 4*b* are provided to the base body 4 below the fixed contact 5 at the center, and a flexible member 7 is accommodated and held between these extension portions 4*a* and 4*b*. A columnar engagement body 34 having a length substantially equal to the thickness of the movable body 6 is assembled into this flexible member 7 in such a manner as to face an engagement recessed portion 33 of the square groove of the movable body 6 so that the columnar engagement body 34 can be engaged with, and disengaged from, the square groove type engagement recessed portion 33 under the flexible operation of the flexible member 7.

Figure 4:
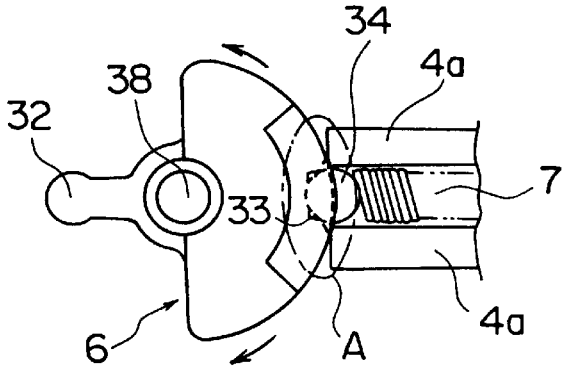
FIG. 4 is a partially cut-away showing a switching operation state of the limit switch by the worm wheel.
Figures 5A, 5B, 5C:
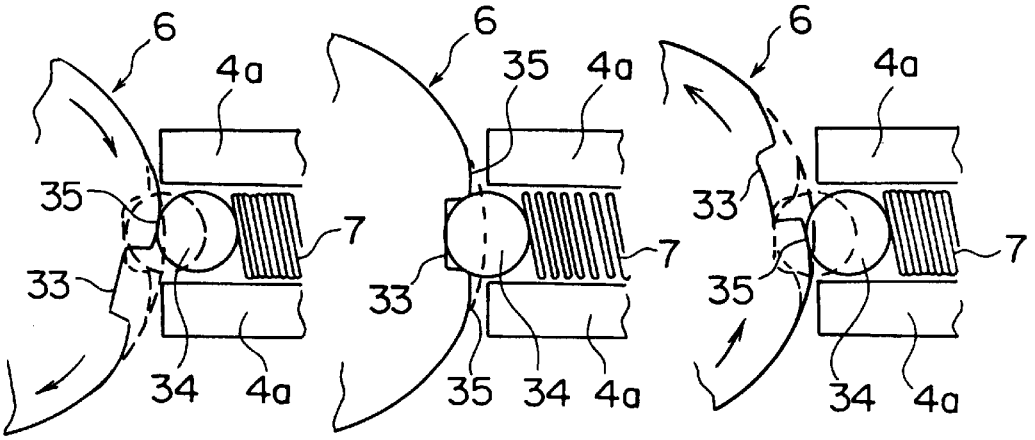
FIGS. 5(*a*)–5(*c*) are views showing the relation between an engagement recessed portion, an engagement body and a flexible member in a moving portion of the limit switch.

Cam portions 35 are so formed on both sides of the square groove engaged recessed portion 33 as to face each other as shown in FIGS. 4 and 5(*a*)–5(*c*). The engagement body 34 is released from the engagement with the square groove type engagement recessed portion 33 under the abnormal load occurrence condition in which the operating force for rotating and driving the worm 1 and worm wheel 2 from the motor 18 acts on the antenna elements, as described already. The cam portion 35 has an angle of inclination and a shape such that the columnar engagement body 34 anchored to the cam portion 35 pushed by the flexible member can properly return to the square groove type engagement recessed portion 33 of the movable body 6 beyond the contact utilizing the slight spontaneous generation force that occurs when the worm wheel 2 reversely moves from its movement limit.

The depth of the square groove type engagement recessed portion 33 is determined so that the columnar engagement body 34 engaging with this recessed portion 33 comes into contact with the bottom surface of the engagement recessed portion 33 at the time of engagement (and for this purpose, the width of the engagement recessed portion 33 is somewhat greater than the diameter of the engagement body 34). Moreover, a value corresponding to the overload value which requires switching within the range which is less than the radius of the columnar engagement body 34 is selected as its depth. In other words, when a predetermined overload value is reached at this engagement depth, the switching operation is effected suitably, and the occurrence of the overload can be effectively prevented.

It is obvious, in principle, that the engagement/contact relationship between the square groove type engagement recessed portion and the columnar engagement body 34 becomes a linear contact, and even when a lubricant or dust adheres to one, or both, of them, the influence of the lubricant or the dust can be sufficiently controlled. When the very delicate influence of the lubricant or the dust can be controlled, the operational relationship between the square groove type engagement recessed portion 33 and the columnar engagement body 34 can be accurately accomplished in accordance with a mechanical design condition, and the overload condition or the start condition after the stop due to the overload can be delicately controlled by the engagement depth of both members 33 and 34 or the detailed structure of the cam portions or the joint portion.

Figure 6A:
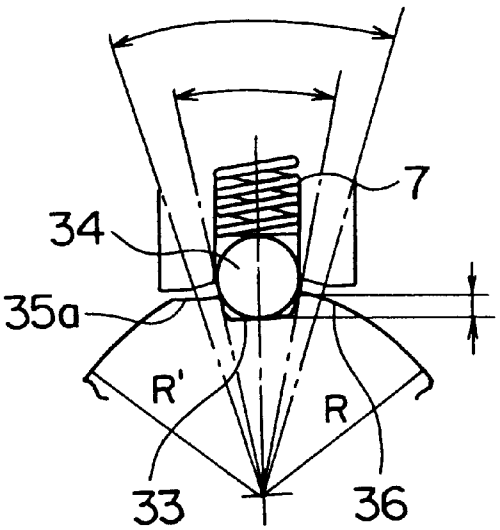
FIGS. 6(A)–6(C) are views showing the construction of a movable body and a columnar engagement body and a switching operation relation.
Figure 6B:
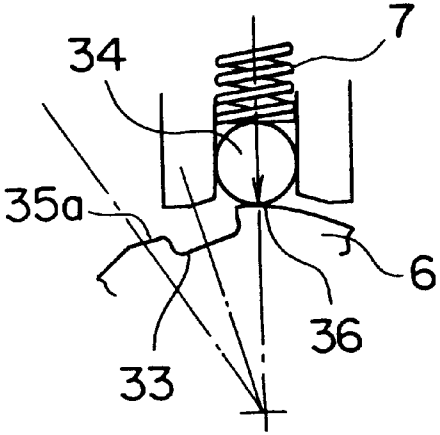
Figure 6C:
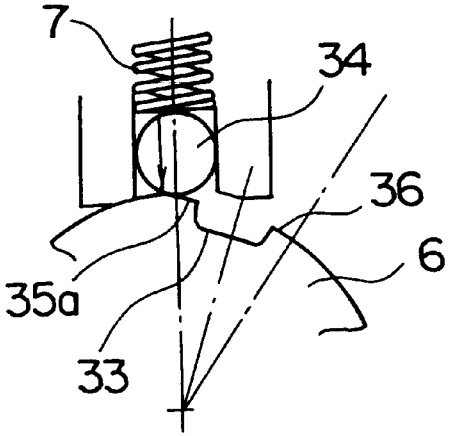
Figure 10:
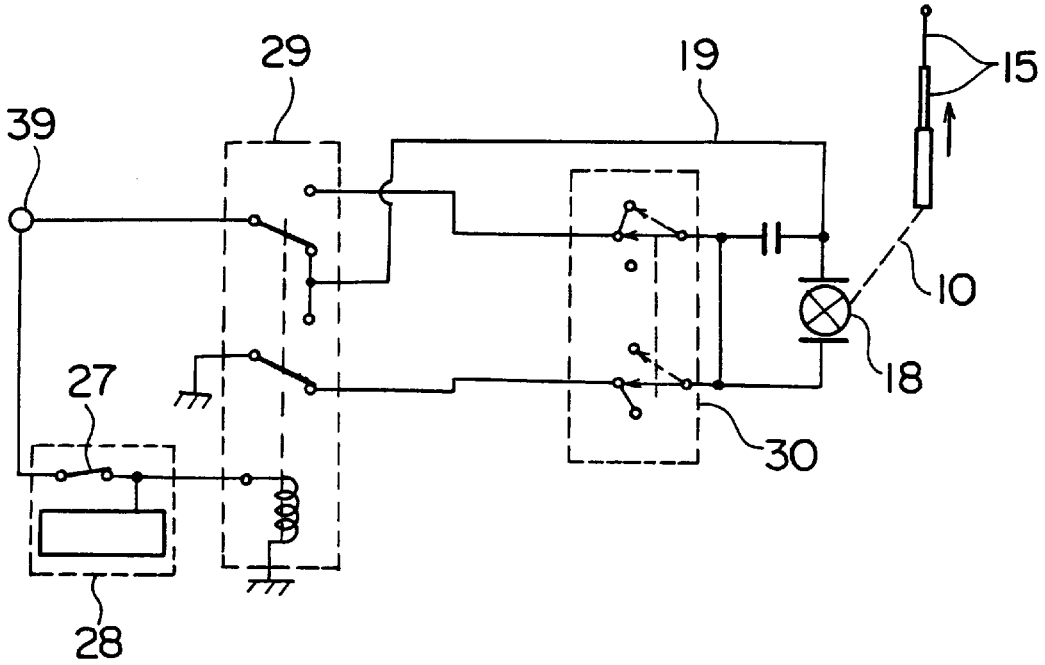
FIG. 10 is a view showing an example of a power supply circuit to a motor according to the present invention in the extended condition of an antenna.

Namely, the cam portion or the joint portion disposed on the side of the engagement recessed portion 33 determines and governs the returning operation of the columnar engagement body 34 which returns the switches on both the ascending and descending operation sides of the antenna to an ON-state from the switching operation state described above and raises or lowers the antenna in either direction from the switching state due to the occurrence of the overload. Besides the structure shown in FIG. 5 wherein the curved cam portion 35 having the same shape and the same height are so disposed as to oppose each other, the cam portion or the joint portion may use the structure shown in FIG. 6(A) wherein only one of them is a straight cam portion 35*a* with the other being the circumference of the movable body 6 to form a joint portion 36, or the structure shown in FIG. 7(A) wherein one of them is likewise a straight cam portion 35*a* with the other being the circumference of the movable body 6 to form the joint portion 36 but the height H' of the cam portion 35*a* from the bottom portion of the rectangular groove type engagement recessed portion 33 and the height H of the joint portion 36 are different with the relation H'>H. Still alternatively, they may use the structure shown in FIG. 7(B) wherein radii of curvature r and r' of the curved portion 35 and 35 disposed on both sides of the rectangular groove type engagement portion 33 are different, or the structure shown in FIG. 7(C) wherein straight cam portion 35*a* and 35*a* having the same height H from the bottom surface of the engagement recessed portion 33 are so disposed as to oppose each other but the angle θ of these straight cam portions 35*a* and 35*a* with respect to the bottom surface of the engagement recessed portion 33 are different. The operational relationship of the structure is typically represented by FIGS. 6(A)–6(C). Namely, FIGS. 6(B) and 6(C) show the operational relationship when the columnar engagement body 34 in FIG. 6(A) is released from the engagement state where it is coupled and is kept in place between both sides of the rectangular groove type engagement recessed portions 33. In other words, FIG. 6(A) shows the state where the columnar engagement body 34 stably fits to the engagement recessed portion 33 and where the switched LSU and LSD on both the antenna ascension and descension sides shown in FIG. 10 are ON, and the operating force for changing this ON state to the OFF state can be correctly set by the engagement depth H or H' of the columnar engagement body 34 with the engagement recessed portion 33. When the columnar engagement body 34 is pushed up and coupled from the state shown in FIG. 6(A) by the joint portion 36 as the circumference of the movable body 6 to the state shown in FIG. 6(B), the operating force of the flexible member 7 acts orthogonally on the circumferential joint portion 36 and under this state, no operating force exists to return to the state shown in FIG. 6(A). In contract, the state shown in FIG. 6(C) is the state where the columnar engagement body 34 is pushed up and coupled with the straight car portion 35*a*, and the switch LSU is ON while the switch LSD is OFF, for example. The operating force of the flexible member 7 under this state acts on the slope of the cam portion 35, and it is obvious that the operating force has the operation of returning to the state shown in FIG. 6(A).

Figure 7A:
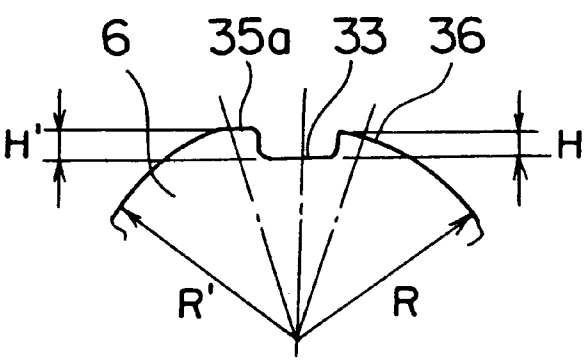
FIGS. 7(A)–7(C) are views showing a structual relationship between the movable body and the columnar engagement body.
Figure 7B:
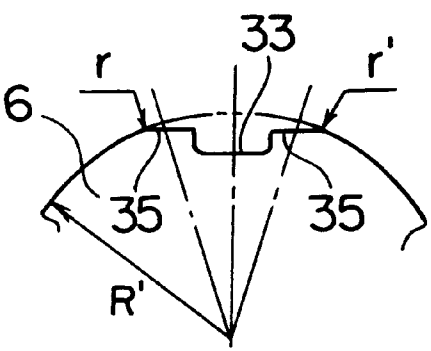
Figure 7C:
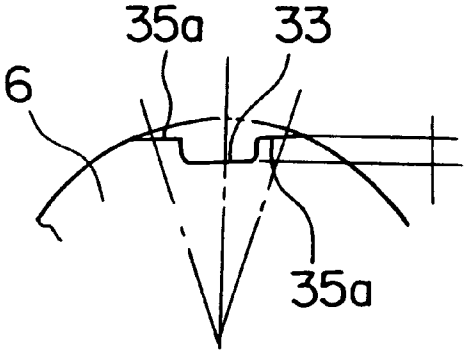

In comparison with the state shown in FIG. 6(A), the state shown in FIG. 7(A) represents the state where the releasing operating force itself is changed due to the difference between the heights H and H' on both sides of the square groove type engagement recessed portion 33. It is obvious that the difference of the radii of curvature r and r' of the curved cam portion 35 shown in FIG. 7(B) delicately changes the operating force after switching, and the set relationship can be suitably and arbitrarily selected in accordance with performance of the electric antenna or its operating condition, inclusive of the joint use of the straight cam portion 35*a* and the curved cam portion 35 shown in FIG. 7(C). Namely, the fitting depth between the square groove type engagement recessed portion 33 and the columnar engagement body 34 and the shape of the cam portion 35 or 35*a* are suitably selected under the condition where the square groove type engagement recessed portion 33 is employed and the influences of the oil such as the lubricating oil and the dust are suitably controlled between the recessed portion 33 and the columnar engagement body 34, and in this way, a mechanism and operation suitable for the characteristics values and the set condition can be positively obtained in the respective electric antenna.

Figure 8:
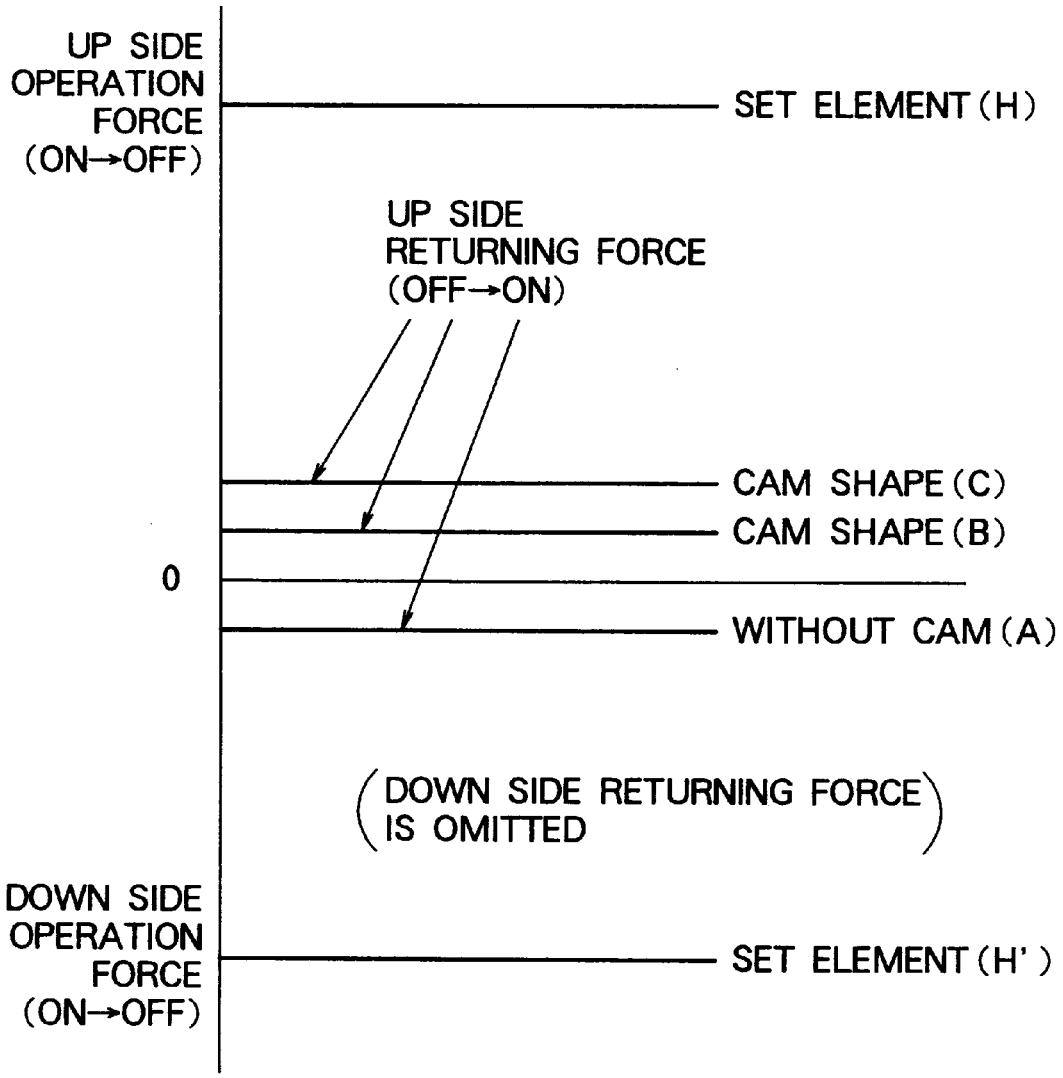
FIG. 8 is a view showing the relationship of an operation force between a cam portion or a joint portion at the side of a square groove type engagement recessed portion of the movable body and the columnar engagement body.

The operational relationship between the cam portion or the joint portion on the side of the square groove type engagement recessed portion and the columnar engagement body 35 is shown in FIG. 8. In the state shown in FIG. 5(*b*) where the columnar engagement body 34 fits into the square groove type engagement recessed portion 33, the operating force is zero (0) as shown at the center of FIG. 8. Because, the columnar engagement body is pushed up onto the steps on both sides of the square groove type engagement recessed portion 33 from this state, the UP side operating force and the DOWN side operating force became the set element (H) or (H') as shown in the drawing. When the columnar engagement body 34 gets on the cam portion due to the UP side operating force, a returning force higher than the force under the zero (0) state can be obtained depending on the shape of the cam portion such as the shape of the cam portion (B) or (C), whereas the negative operating force occurs under this state in the case of the joint portion 36 as the part of the circumference of the movable body 6 devoid of the cam portion. Therefore, the operation of the joint portion 36 occurs on the negative side from the zero state of the operating force as shown in FIG. 8, and the LSU does not return to ON from OFF unless the reaction force at the time of descending operation operates, for example.

The worm wheel 2 described above has the structure separately shown in FIG. 9, and effects step-wise switching operation of the movable body 6 as shown in FIGS. 9(A), 9(B) and 9(C). In other words, the worm wheel 2 is driven while meshing with the worm 1. The worm wheel 2 comprises an integral unit of the first worm gear 3 as a gear having a large diameter and the second worm gear 3*a* as a gear having a small diameter as shown in FIG. 1, and the second worm gear 3*a* having a small diameter meshes with the interlocking gear 13 so as to rotate the moving operation rotary body 12 and to extend or contract the wire 10. An engagement groove 21 is defined between these first and second worm gears 3 and 3*a*, and the movable body 6 and the operation portion 32 are meshed with each other.

Bearing portions 23 are disposed coaxially on both end surfaces of the work wheel assembly having integrally the first and second worm gears 3 and 3*a* as described above in such a manner to oppose each other, and a shaft portion 24 provided to the case member 16 is inserted into each bearing 23 and rotatably support the worm wheel 2. A ring-like buffer member 25 is interposed between the shaft portion 24 and bearing portion 23, and mitigates the occurrence of an impact at the time of the switching operation of the worm wheel shown in FIGS. 9(A)–9(C).

Besides the arrangement shown in FIGS. 9(A)–9(C) wherein the buffer member 25 is disposed in the bearing portion 23, the buffer member 25 can be set to the outer surface of the shaft portion 24 so that the impact can be prevented between the ring-like protuberance portion 26 formed outside a hole-like bearing portion 23 of the worm wheel 2 and the case member 16.

The embodiment described above and shown in the drawings represents the case where the movable body 6 of the limit switch is rotated by the rotary shaft 38. Besides the movable body of the rotary type. the present invention can also use other movable bodies of a slide type, and the like. In other words, even in the movable body of the rotary type, its operation force is attained by the slide operation of the engagement groove 21 between the first and second worm gears 3 and 3*a*. Therefore, the switch operation by the slide system can be accomplished by restricting the moving direction of the movable contact of the limit switch in FIGS. 9(A)–9(C) and stipulating the vertical direction of the sheet of the drawing in FIG. 3.

Figure 11:
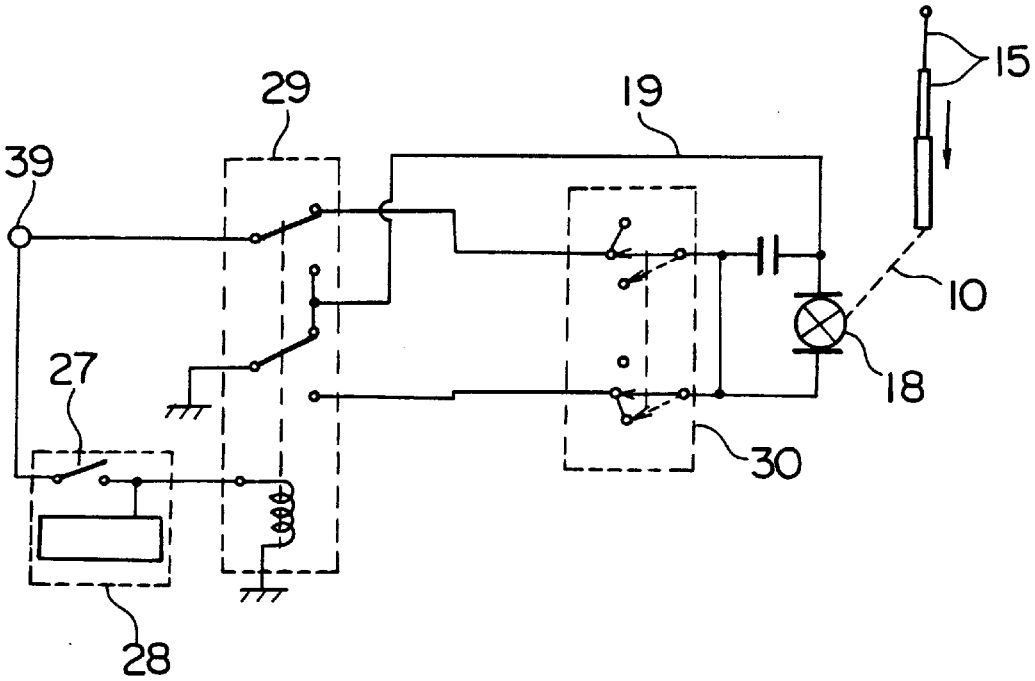
FIG. 11 is a view showing the contracted state of the antenna shown in FIG. 7.
Figure 12A:
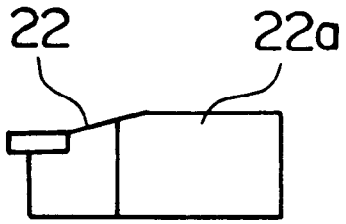
FIGS. 12(A)–12(C) are views of a front surface, a bottom surface, respectively, and a side surface of a cover body.
Figure 12B:
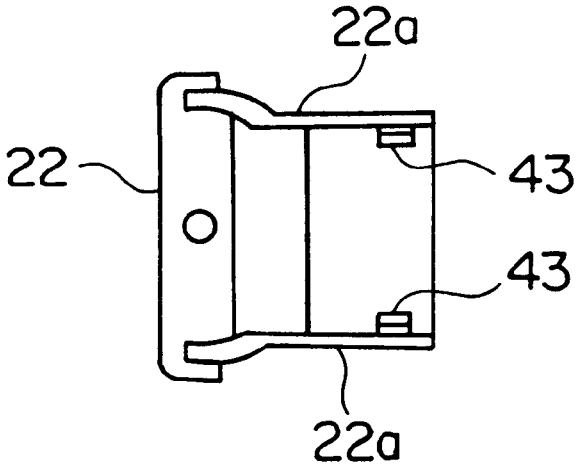
Figure 12C:
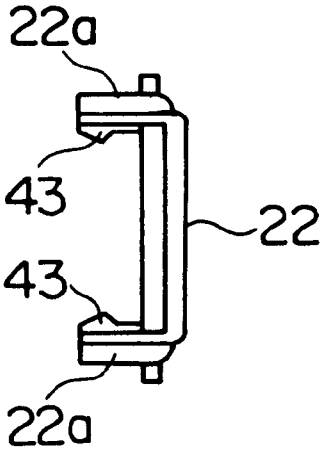

An example of the power supply circuit for the motor 18 in the telescopic operation mechanism described above and its operational relationship are shown in FIGS. 10 and 11. A relay circuit 29 and radio circuit 28 having a radio switch 27 are coupled with the limit switch 30 comprising the antenna UP switch portion LSU and the antenna DOWN switch portion LSD in the motor circuit 19 for the motor 18 for the telescopic operation of the antenna element 15.

FIG. 10 shows the state where the antenna element 15 is contracted. When the radio switch 27 is turned ON from the state shown in FIG. 10, the state changes to the one shown in FIG. 11, and the relay circuit 29 operates. In consequence, the motor circuit 19 interposed between the power supply and the motor 18 is closed to thereby rotate the motor 18 in the toward direction and to extend the antenna element 15. Furthermore, the DOWN switch portion SD of the limit switch 30, too, is turned ON. When the antenna element 15 reaches its extension limit and the abnormal load to the antenna element 15 occurs, the DOWN switch portion LSD of the limit switch 30 is charged over from the OFF state shown in FIG. 10 to the state shown in FIG. 11, and the supply of power to the motor 18 is stopped.

When the radio switch 27 is turned OFF as shown in FIG. 11, the relay switch 29 is switched, and the supply of power to the motor 18 becomes opposite to that of the case of FIG. 10, and the antenna element 15 is contracted. When the antenna element 15 reaches its lower limit, the limit switch 30 detects the abnormal load at the lower limit and is changed over to the state represented by the dashed line in FIG. 11. In consequence, the supply of power to the motor 18 is turned OFF, and the antenna element 15 is kept in the contracted state. When the antenna element 15 receives the abnormal load during its intermediate-stage extending operation, the limit switch operates similarly and cuts OFF the supply of power to the motor 18. Therefore, the mode enters the waiting mode for the next ON-OFF operation of the radio switch.

In the construction wherein the moving operation rotary body such as the drum or the gear for moving the wire or the rope for telescopically operating the antenna element is rotated by the worm or the worm wheel driven by the motor and the limit switch for preventing the overload is provided to the power supply circuit for the motor, the worm wheel is supported slidably in the axial direction, the engagement groove is formed in the ring form on the worm wheel and the operation portion of the movable body of the limit provided to the driving circuit for the motor is engaged with the engagement groove of the worm wheel. Accordingly, the rotation of the worm is transmitted to the worm wheel, the worm wheel receives any propulsion force along the support shaft by the driving force of rotation, and the engagement groove of the worm wheel contacts the operation portion of the movable body of the limit switch disposed in the power supply circuit for rotating forwardly or reversely the motor. When the moving operation rotary body stops as it reaches the extension limit or the contraction limit to the antenna element during the normal driving operation, or due to the abnormal load during the intermediate extension operation, the continued rotation of the worm increases the propulsion force of the worm wheel and the engagement groove operates the operation portion of the movable body to activate the limit switch.

The square groove type engagement recessed portion is formed on the movable body, and the columnar engagement body operating under the resilient condition is meshed with this engagement recessed portion within the range not greater than the radius thereof. Further, the cam portions or the joint portions for releasing the engagement body from the engagement recessed portion and keeping it at a halt by the operating force for rotating and driving the worm and the worm wheel from the motor at the stop of the extending or contracting operation of the antenna element are disposed on the sides of the square groove type engagement recessed portion of the movable body. At the start of the operation, the engagement body engages with the square groove type engagement recessed portion of the movable body to thereby secure the ON state of the limit switch, and when the moving operation rotary body stops at the extension or contraction limit of the antenna element or at the intermediate stage of the extension operation due to the abnormal load, the worm wheel itself is moved in the axial direction by the rotation driven force to the worm wheel, so that the movable body engaging with the engagement groove of this worm wheel is operated and the columnar engagement body engaging with the engagement recessed portion is released and anchored to the cam portion or the joint portion.

In other words, a predetermined contact state is established within the range of the anchor force of the engagement body set between the shapes of the columnar engagement body and the cam portion or the joint portion under the resiliency of the flexible member, and the OFF state of the limit switch is maintained. Further, the movable body operates by the operation force of the reverse movement from the moving limit of the worm wheel, the columnar engagement body that has been anchored to the cam portion is again returned into the square groove type engagement recessed portion and at the same time, the limit switch secures the ON stage. Therefore, a large operating force is necessary for the columnar engagement body to shift from the state where it engages with the square groove type engagement recessed portion to the state where it is released and is anchored to the cam portion or the joint portion, and this operating force can be allowed to correspond to the operating force required for the telescopic operation of the antenna element. In contrast, when the columnar engagement body is anchored to the cam portion or the joint portion, the reverse operating force for returning the columnar engagement body to the square groove type engagement recessed portion does not all exist, the columnar engagement body does not reach the engagement state where it returns to the square groove type engagement recessed portion unless any operating force overcoming the contact resistance at the engagement point is given. Therefore, the ON-OFF repetition operation of the limit switch can be appropriately prevented.

The movable body of the limit switch is rotatably supported by the base body equipped with the fixed contact plate of the limit switch. The operation portion meshing with the engagement groove of the worm wheel is disposed on one of the sides of the movable body and the movable contact plate is disposed on the other side. The fixed contact plate of the limit switch is provided to this movable contact plate. Accordingly, a suitable interlocking operation can be obtained between the worm and the movable body of the limit switch, and the operation can be carried out more smoothly by the switch construction of the rotary operation system.

The rotary shafts are so aligned symmetrically on the same axis of both surface of the movable body of the limit switch as to protrude from the surface. One of these rotary shafts is supported by the wiring substrate and the other is supported by the cover body removably fitted to the same body. Accordingly, the movable body can be supported by utilizing the cover body for the wiring substrate and the base body, the number of necessary components becomes small, and the rotary switch can be formed by a simple construction.

The base body includes the extension portions for holding the engagement body and the flexible member and the fitting seat equipped with a plurality of fixed contact plates for constituting the limit switch. The engagement recessed portions are so formed at both end portions of the fitting seat as to oppose each other, and the protuberances for meshing with these engagement recessed portions are provided to the cover body so that the engagement body, the flexible member and the fixed contacts can be integrated with respect to the movable body, and the stable operational relationship can be correctly maintained. Further, because the wiring substrate is directly employed as a part of the housing of the limit switch, the effective limit switch can be obtained by merely fitting the switch constituent members.

The worm wheel includes the first gear wheel portion for meshing with the worm driven by the motor, and the second gear wheel portion meshing with the interlocking gear for driving, and the engagement groove for the operation portion of the switching plate of the limit switch is formed in the ring form between these first and second gear wheel portions. Therefore, the moving operation rotary body for operating the wire or the rope can be accurately operated by the single worm wheel from the worm driven by the motor, and moreover, this operation can be carried out smoothly while the switching operation balance of the limit switch is kept stable.

The shaft portions are so disposed on the same axis at the end faces of the worm wheel as to oppose each other, and the bearing portions fitted to these shaft portions are provided to the case body to which the worm wheel is set. The buffer member is interposed between the bearing portion and the shaft portion, so that the occurrence of the impact during the moving operation of the worm wheel can be prevented.

The limit switch is fitted to the wiring board, and the proximal end portion of the fixed contact of the limit switch is connected to the circuit formed on the wiring board in such a manner as to turn ON/OFF the power supply circuit for the motor. Therefore, the power supply circuit for the motor can be formed into a simple construction with a smaller number of necessary components and the supply of power can be made stably.

INDUSTRIAL APPLICABILITY

As described above, the device for telescoping the power antenna for a car in accordance with the present invention does not require the clutch mechanism of the conventional apparatuses but can effect the automatic telescopic operation, can effectively eliminate the causes for fluctuation such as lubricating oil and dust in the mechanical engagement/contact operation construction, can employ a suitable construction in accordance with the characteristic values and the design condition of the electric antenna, utilizes even a slight force spontaneously occurring at the time of reverse movement of the worm wheel, stops automatically and accurately the motor at the time of the occurrence of the abnormal load at the extension/constraction limit of the antenna by switching of the limit switch, can thus eliminate burning out of the motor and the damage of the telescopic operation mechanism, can correctly inhibit the repetition of the ON/OFF operation of the switch, and can provide an automatic antenna having high reliability.

I claim:

1. A device for telescoping a telescopic power antenna, comprising:

a moving operation rotary body arranged to move a wire or a rope for telescopically operating a telescopic antenna element;

a worm wheel driven by a motor and coupled to said rotary body for causing rotation of said rotary body; and an overload prevention limit switch coupled in a power supply circuit for said motor;

wherein said worm wheel is slideably mounted so as to be slideable in an axial direction thereof, and has an engagement groove formed thereon;

wherein said limit switch comprises a movable body with an operation portion thereon, said operation portion being coupled in a driving circuit for said motor and being engaged with said engagement groove of said worm wheel;

wherein said movable body has a square groove engagement recessed portion formed therein;

a columnar engagement body resiliently urged by a flexible member into engagement with said square groove engagement recessed portion within a range of a height not greater than the radius of said columnar engagement body; and cam portions disposed on sides of said square groove engagement recessed portion of said movable body such that said columnar engagement body is kept unlocked from the square groove engagement recessed portion by an operating force of said motor for driving and rotating a worm and said worm wheel under a condition of an occurrence of an abnormal load relative to the antenna element.

2. A device for telescoping a telescopic power antenna according to claim 1, wherein:

said movable body of said limit switch is supported rotatably so as to oppose a base body on a wiring board having a fixed contact plate of said limit switch, said operation portion of said movable body engaging with said engagement groove of said worm wheel, said operation portion protruding on one of the sides of the movable body; and further comprising a moving contact plate disposed on another side of the movable body, said fixed contact plate of said limit switch being arranged for contact with said movable contact plate.

3. A device for telescoping a telescopic power antenna according to claim 2, wherein:

rotary shafts are arranged on a same axis on both sides of said movable body of said limit switch, and said rotary shafts projecting from said movable body; and one of said rotary shafts is coupled to said wiring board so as to be supported by said wiring board, and the other of said rotary shafts being coupled to a cover body which is detachably mounted to a base body.

4. A device for telescoping a telescopic power antenna according to claim 3, wherein:

said base body includes an extension portion with a flexible member coupled thereto, and a fitting seat having a plurality of fixed contact plates for constituting said limit switch;

said fitting seat has engagement recessed portions formed at both end portions of said fitting seat; and said cover body has protuberances engaging with said engagement recessed portions of said cover body.

5. A device for telescoping a telescopic power antenna according to claim 1, wherein said worm wheel includes:

a first gear wheel portion engaging with a worm driven by said motor;

a second gear wheel portion engaging with an interlocking gear for driving said moving operation rotary body; and a ring-shaped engagement groove for said operation portion of said movable body of said limit switch formed between said first and second gear wheel portions.

6. A device for telescoping a telescopic power antenna according to any one of claims 3, 4 or 5, wherein:

said worm wheel has shaft portions arranged on a same axis on end surfaces of said worm wheel as to oppose each other;

said base body has bearing portions engaging said shaft portions; and a buffer material is interposed between said bearing portions and said shaft portions.

7. A device for telescoping a telescopic power antenna according to any one of claims 3, 4 or 5, wherein:

said limit switch is mounted on said wiring board; and a proximal end portion of said fixed contact plate of said limit switch is connected to a circuit formed on said wiring board so as to turn ON and OFF said power supply for said motor.

8. A device for telescoping a telescopic power antenna according to claim 6, wherein:

said limit switch is mounted on said wiring board; and a proximal end portion of said fixed contact plate of said limit switch is connected to a circuit formed on said wiring board so as to turn ON and OFF said power supply for said motor.

9. A device for telescoping a telescopic power antenna according to claim 1 or 2, wherein:

the device includes a base body, a cover body detachably mounted to said base body, and a wiring board coupled to said base body;

said worm wheel has shaft portions arranged on a same axis on end surfaces of said worm wheel as to oppose each other;

said base body has bearing portions engaging said shaft portions; and a buffer material is interposed between said bearing portions and said shaft portions.

10. A device for telescoping a telescopic power antenna according to claim 1 or 2, wherein:

said limit switch is mounted on said wiring board; and a proximal end portion of said fixed contact plate of said limit switch is connected to a circuit formed on said wiring board so as to turn ON and OFF said power supply for said motor.

11. A device for telescoping a telescopic power antenna according to claim 9, wherein:

said limit switch is mounted on said wiring board; and a proximal end portion of said fixed contact plate of said limit switch is connected to a circuit formed on said wiring board so as to turn ON and OFF said power supply for said motor.

12. A device for telescoping a telescopic power antenna according to claim 1, wherein said rotary body comprises a drum.

13. A device for telescoping a telescopic power antenna according to claim 1, wherein said rotary body comprises a gear.

* * * * *